US007010830B2

(12) United States Patent
Sirochman

(10) Patent No.: US 7,010,830 B2
(45) Date of Patent: Mar. 14, 2006

(54) REPAIR USING PLASTIC AS THE SLIDING MECHANISM FOR LATERALLY SLIDING DOORS/WINDOWS

(76) Inventor: Joseph William Sirochman, 150 Hardy Way, Hiram, GA (US) 30141

( * ) Notice: Subject to any disclaimer, the term of this patent is extended or adjusted under 35 U.S.C. 154(b) by 0 days.

(21) Appl. No.: 10/608,961

(22) Filed: Jun. 30, 2003

(65) Prior Publication Data

US 2004/0261321 A1 Dec. 30, 2004

(51) Int. Cl.
*E05D 15/00* (2006.01)
*A47H 15/00* (2006.01)

(52) U.S. Cl. ..... 16/93 R; 16/96 R; 16/42 R; 16/87.8; 49/413; 49/404; 49/428; 49/425

(58) Field of Classification Search ..... 16/93 R, 16/94 R, 96 R, 87.2, 42 R, 44, 87.8; 49/413, 49/404, 428, 425; 4/557, 607, 610
See application file for complete search history.

(56) References Cited

U.S. PATENT DOCUMENTS

| | | | | |
|---|---|---|---|---|
| 3,653,157 | A * | 4/1972 | Casebolt | 49/411 |
| 3,861,444 | A * | 1/1975 | Portwood | 160/90 |
| 4,208,755 | A * | 6/1980 | Shepherd | 15/160 |
| 4,611,436 | A * | 9/1986 | Williams | 49/425 |
| 4,800,619 | A * | 1/1989 | Hudak | 16/95 R |
| 4,912,807 | A * | 4/1990 | Futch et al. | 16/90 |
| 6,584,664 | B1 * | 7/2003 | Hostetler et al. | 29/402.01 |
| 2004/0098940 | A1 * | 5/2004 | Latessa et al. | 52/514 |

* cited by examiner

*Primary Examiner*—Chuck Y. Mah

(57) ABSTRACT

The invention pertains to the repair of the sliding mechanism of horizontally or laterally sliding glass doors/windows, including shower doors, that are permanently built into a residential or commercial building. Instead of the door/window riding on a metal track using a roller mechanism on a metal rail during the opening and closing process, the door/window rides on strips of either the same or different types of plastic, such as a high density polyethylene plastic, for the same process. Basically plastic is adhered to the current tracking system of the door/window and additional plastic is adhered so a portion of the plastic is under the actual door/window. The door/window slides across the door/window track using the plastic as the main sliding mechanism instead of the rail and roller mechanisms as currently supplied by most door/window manufacturers.

1 Claim, 3 Drawing Sheets

REPAIR USING PLASTIC AS THE SLIDING MECHANISM FOR LATERALLY SLIDING DOORS/WINDOWS

FIELD OF THE INVENTION

The invention relates to the repair of the sliding process of horizontally sliding doors and windows, where the door/window slides on plastic as the main sliding mechanism versus a rail and roller mechanism as currently used.

PRIOR ART

Laterally sliding windows, including such windows as commonly referred to as sliding doors, are well known. To ease movement of sliding glass windows, wheeled rollers have been provided on the base of the window which roll on a thin vertical metal track.

The weight bearing metal tracking is usually made out of a softer metal such as aluminum. The roller mechanisms for sliding doors and windows tends to place the entire weight of the sliding door/window, which can be a relatively large load compared to the size of the track rail and rollers, on the relatively thin metal rail that the rollers ride on. Due to the softness of the aluminum, the metal rail on which the roller rides usually flattens out or wears down over time causing either the tracking and/or rollers to wear out.

To replace those parts, normally a person would have to completely disassemble the door/window, cut out the worn tracking and/or replace the rollers then reassemble the door/window. This is not only very time consuming job requiring some skill but can also be very costly.

Other inventions such as "Roller for Sliding Windows and Doors" U.S. Pat. No. 5,273,363, Prete issued Dec. 28, 1993, refers to a redesign of the rollers using belts instead of metal wheeled rollers which would require a redesign of the tracking system of the door/window.

Another invention "Modular Sliding Door Rollers", U.S. Pat. No. 5,950,279, Chaput, issued Sep. 14, 1999, refers to a redesign of rollers to carry the weight of a sliding glass door/window where the rollers are the main sliding mechanism.

The invention "Track Wiper for Sliding Shower Door Assembly" U.S. Pat. No. 4,208,755, Shepard, issued Jun. 24, 1980 refers to placing a wiper to remove liquid and solid residue from the track of a sliding door and has nothing to do with repairing the actual problem of worn tracks and/or rollers.

The invention "Wear Insert for a Door Channel", U.S. Pat. No. 4,800,619, Hudak, issued Jan. 31, 1989 refers to placing plastic in the channels where a roller rides. However, that patent pertains mainly to roll up doors, requires special manufacturing of the door tracks, still does not properly address the problem with laterally sliding glass doors/windows and still maintains the use of metal rollers rolling on a replaceable piece of plastic.

Another invention, "Sliding Door/Window Track Assembly" U.S. Pat. No. 4,912,807, Futch issued Apr. 3, 1990 refers to using plastic as a main sliding mechanism. However, the patent again discusses manufacturing the door/window sliding mechanisms using a completely different design and manufacturing than what is already in use and/or installed.

However different the roller mechanisms are and where they ride, they are still just basically a redesign of the current system or a completely different design requiring specialty manufacturing of the door/window track and their associated parts.

No matter how good those designs may be, they still do not address the problem of sliding doors/windows that are already installed in a building, yet have worn tracks and/or rollers thereby making the door/window hard to slide.

Most people think of metal being highly durable and plastic as being not very durable. By using a plastic, such as a high density polyethylene plastic, as a replacement for the main sliding mechanism, the plastic is highly durable and has a low friction coefficient which makes the door/window slide relatively easily.

There are no other inventions relating to using plastic as a repair that easily replaces the main sliding mechanism of a door/window. There is also no known device that is quick and easy to install for the average person, requires no special manufacturing or substantial changes to current parts already in manufacture and accomplishes the object of using plastic as the main sliding mechanism on a glass sliding door/window.

OBJECTS AND ADVANTAGES OF THE INVENTION

Accordingly, several objects and advantages of the invention are to use a plastic, such as a high density polyethylene polymer, as the main sliding mechanism during the opening and closing of a structurally intact horizontally sliding door/window where the rail and roller mechanism are either partially or completely void of their function and to have the door/window still slide relatively easy.

It is also the object of the invention to provide a simple, cost effective way to produce these results that does not require substantial alterations of an intact sliding door/window.

Another object of the invention is to have the plastic easily and cost effectively installed or replaced when worn, unlike the current roller and rail mechanism, where the sliding door/window has to be completely disassembled to perform the necessary repairs.

Another object of the invention is to have the average person be able to attach the device to their sliding glass doors/windows without any special knowledge or special tools.

Another advantage to the invention is that the door/window slides quietly unlike the rumbling sound sliding door/windows make with metal rollers on metal tracking.

Another advantage of the invention is that, with a slight variation, it can be used on shower doors to repair a shower door from dragging on the lower track or sliding roughly.

Further objects and advantages of my invention will become apparent from a consideration of the drawings and ensuing description.

BRIEF DESCRIPTIONS OF THE DRAWINGS

LIST OF REFERENCE NUMERALS

Figure 1:
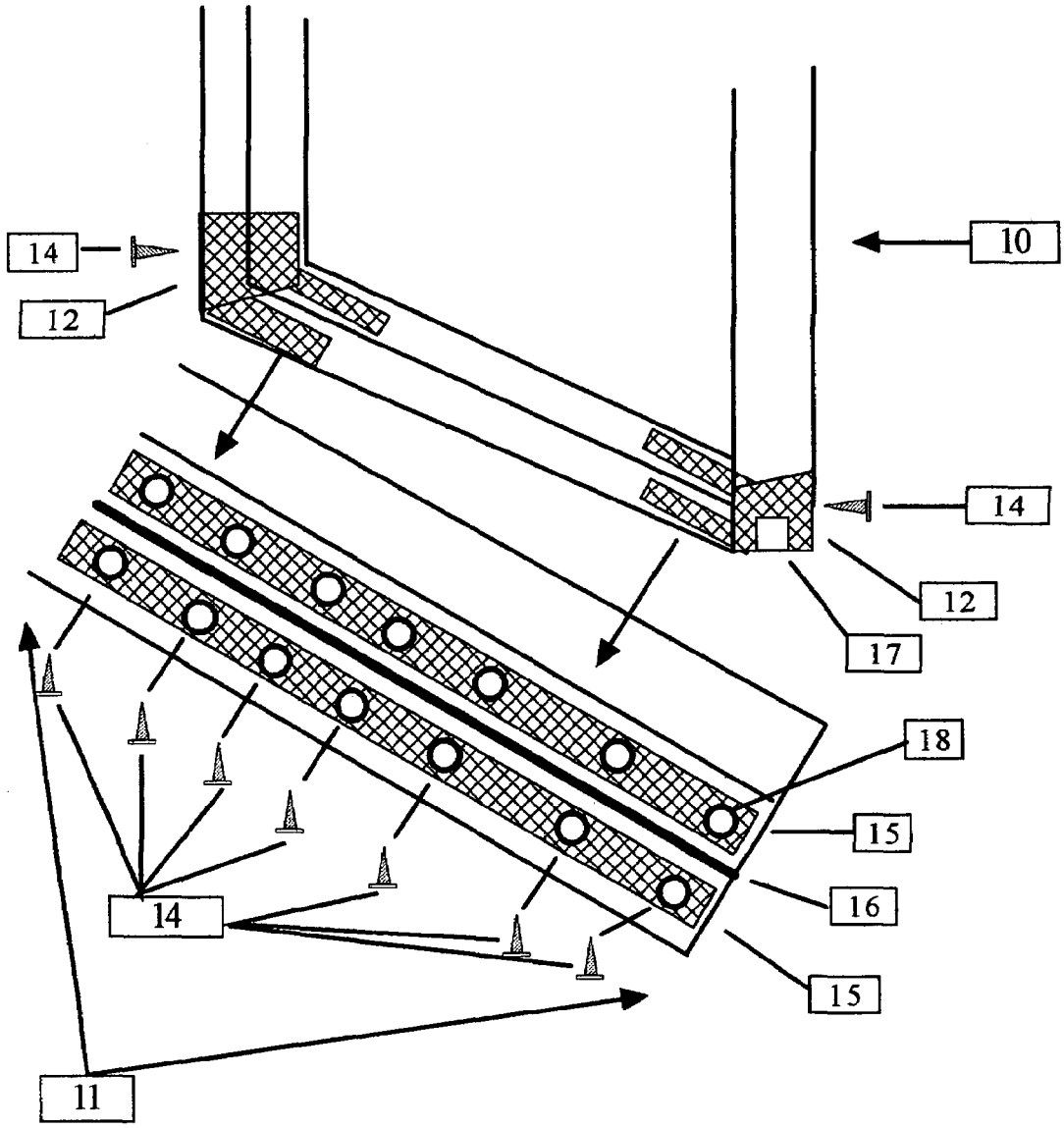
FIG. 1 is an overall view of a glass sliding door/window showing the placement and alignment of the plastic on the door/window and its track.

| FIG. | Description |
|---|---|
| 10 | glass sliding door/window |
| 11 | door/window track |
| 12 | plastic corner bracket |
| 13 | plastic shim with double-sided tape |
| 14 | self-drilling screws |
| 15 | plastic tracking strip with pre-drilled screw holes |
| 16 | roller rail |
| 17 | notch running length of door/window containing rollers |
| 18 | Pre-drilled holes in tracking strip |

SUMMARY OF THE INVENTION

By using plastic on the corners of doors/windows and having the plastic come in constant contact and placing the weight of the door on the plastic adhered to the tracking, doors/windows slide relatively easily without time consuming and/or costly replacement of existing parts.

DETAILED DESCRIPTIONS OF THE DRAWINGS

While this invention is susceptible of embodiments in many different forms, there is shown in the drawings and hereinafter describe in detail, a preferred embodiment of the invention with the understanding that the present disclosure is to be considered as an exemplification of the principals of the invention and is not intended to limit the broad aspects if the invention to the embodiment illustrated.

FIG. 1 is an overall drawing of a preferred embodiment of this invention. This figure shows where a flat plastic, such as a high density polyethylene polymer, is laid flat on a door/window track (11) being used as a plastic tracking strip (15). The tracking strip (15) has pre-drilled holes in it (18) so that the self-drilling screws (14) counter-sink. The plastic tracking strip (15) runs the entire length of the track and is adhered next to and on both sides of the existing roller rail (16).

Another of the same or different type of flat plastic and bent with roughly a 90 degree or so angle with a split up the middle is called a corner bracket (12). The corner bracket (12) is attached on both ends of the door/window (10). One portion of the corner bracket (12) being horizontal and placed under the door/window (10) with the split straddling the roller rail (16) and lining up with the notch in the door (17) containing the door/window rollers and the other portion being vertical partially going up the side of a door/window (10). The vertical portion of the corner bracket (12) is then adhered to the side of the door/window (10).

Figure 2:
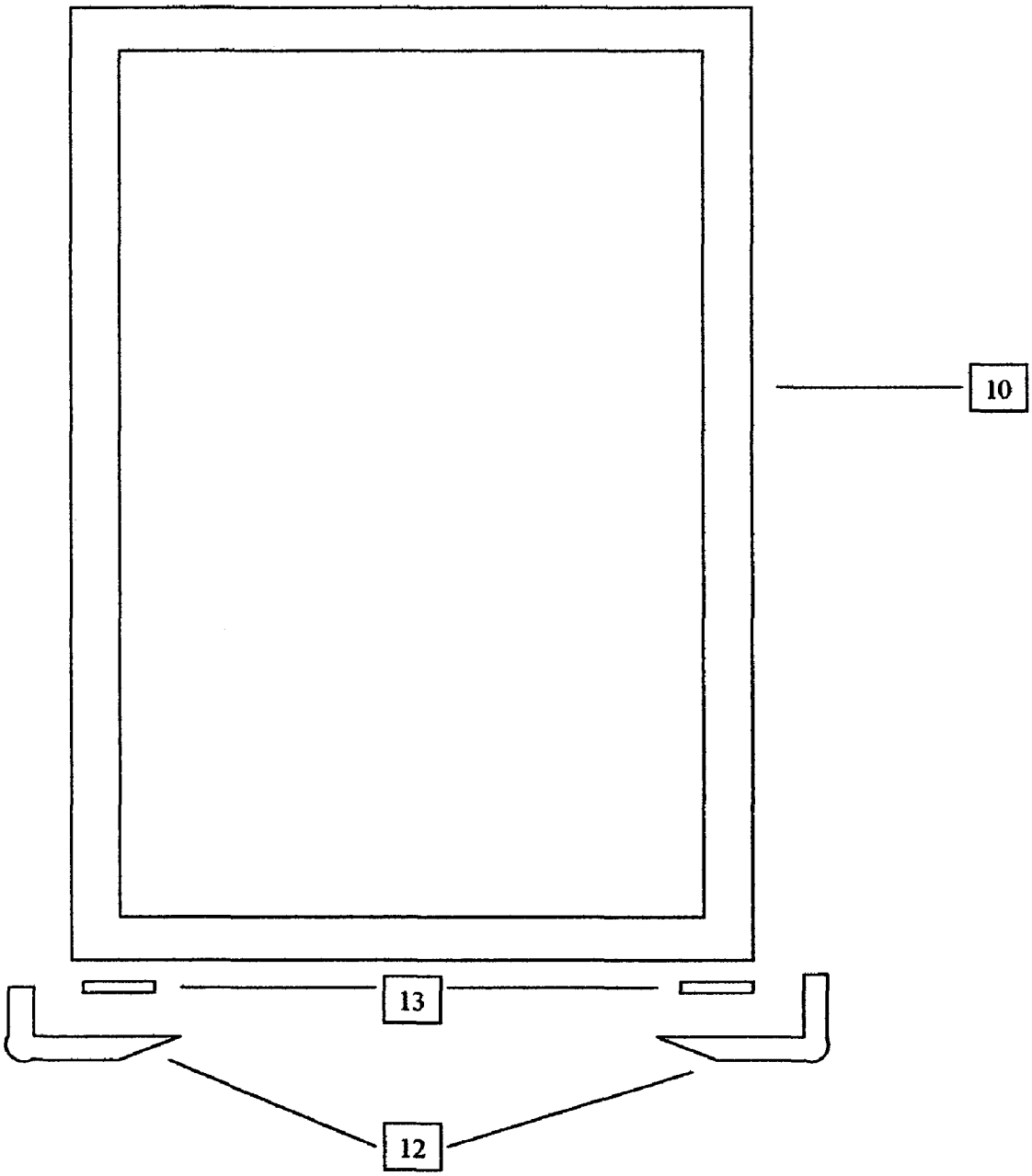
FIG. 2 is a side view of a door/window showing the placement of plastic on the corners of the door/window and the use of shims for adjustment.

FIG. 2 refers to the placement of parts onto the door/window (10) whereby the corner brackets (12) are placed. Shims (13) made of the same or different type of plastic, having a double-sided adhesive on one side and about the same width and size of the horizontal portion of the corner bracket (12). Self-drilling screws (14) are used to adhere the corner brackets (12) onto the door/window (10).

Figure 3:
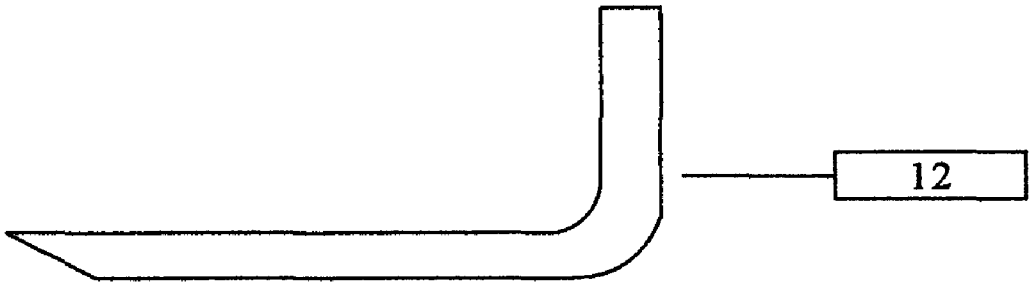
FIG. 3 is a side view of the bent plastic that goes on the corner of the door/window.

FIG. 3 shows a side view of the corner bracket (12). The side opposite the bend is angled. The side with the bend is curved.

Figure 4:
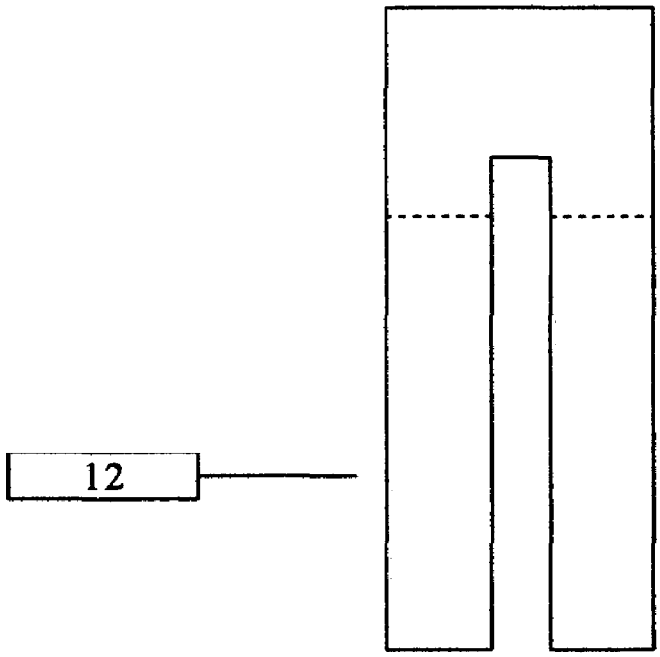
FIG. 4 is a top view of the plastic that goes on the corner of the door/window. The dotted line shows approximately where the plastic is bent.

FIG. 4 shows a top view of the corner bracket (10) with the split in the plastic where the split straddles the roller rail (16). The dotted line shows approximately where the bend is placed in the corner bracket (10).

OPERATION OF THE INVENTION

The invention operates by taking the weight of a laterally sliding glass door/window (10) off of the current rail and roller system, and transfers the weight over to the plastic that makes up the corner brackets (12) adhered to the door/window (10) and plastic tracking strip (15) that is adhered to the door/window track (11). The plastic has a low friction coefficient that makes the opening and closing of glass sliding doors/windows relatively easy.

The corner brackets (12) are angled at the end opposite the bend and bent or curved on the side with the vertical portion in such a manner to allow the corner bracket (12), while opening or closing the door/window, to ride over any dirt or debris that may have gotten in the door track.

The split in the corner bracket (12) straddles the roller rail (16) keeping the door/window (10) running straight along the track using the roller rail (16) as a guide.

The tracking strip (15) has pre-drilled holes in it, at so many inches apart, for attachment of the tracking strip (15) to the door/window track (11) using self-drilling screws (14). The pre-drilled holes (18) enable the self-drilling screws (14) to counter-sink so that the self-drilling screws will not interfere with the corner brackets (12) during the normal opening and closing operation of the door/window (10).

Shims (13) made up of the same or different material and with a double-sided adhesive can be adhered on top of one or both sides of the horizontal portion of the corner brackets (12), for adjustment of the door/window (10) with the stationary frame attached to the building. Shims (13) are also used to ensure the horizontal portion of the corner brackets (12) come in constant contact with the plastic tracking strip (15) that runs the entire length of the door/window track (11). One or multiple shims (13) on one or both of the corner brackets (12) may be necessary for proper adjustment of the door/window (10) with the frame attached to the wall.

CONCLUSIONS, RAMIFICATIONS AND SCOPE OF THE INVENTION

Thus the reader will see that, by using plastic as the main weight bearing and sliding mechanism for glass sliding door/windows, the invention provides a highly reliable, easily installed, economically repairable device that most any person can install themselves to repair a door/window that does not slide easily.

While my above description contains many specificities, these should not be construed as limitations on the scope of my invention, but rather as an exemplification of one preferred embodiment thereof. Many other variations are possible.

For example, instead of using screws for adhering the plastic to the metal; glue, double sided tape or another type of adhesive may be used.

Another example would be to have the plastic attached to the door/window and run partially or the entire length of the door/window versus using plastic on just the corners of the door/window.

A third example would be to have a piece of bent plastic attached to the door/window on one side of the roller rail and the tracking strips placed only on one side of the roller rail.

A fourth example would be to make one or more parts out of a plastic polymer or a combination of plastic polymers, such as Teflon, that have an even lower friction co-efficient of high density polyethylene.

A fifth example would be to manufacture sliding glass doors and windows using plastic in the door and on the track as the main sliding mechanism.

Although a preferred form of my invention for a sliding door/window and its sliding system has been shown and described herein, it should be understood that the present disclosure is made by way of example only and that variations are possible without departing from the subject matter coming within the scope of the following claims and a reasonable equivalency thereof, which subject matter I regard as my invention.

What is claimed is:

1. A device for repairing a sliding glass door/window sliding on a roller rail of a track, using plastic with a low friction coefficient as a main sliding mechanism, comprising:

at least one plastic tracking strip having a predetermined length, width and thickness, said tracking strip being attached to the entire length of said track next to the roller rail;

at least one plastic corner-bracket strip having a predetermined length, width and thickness, said corner-bracket strip being bent in roughly 90 degrees widthwise defining a horizontal portion and a vertical portion, in the middle of said corner-bracket strip a split extending lengthwise from a portion of said vertical portion through said horizontal portion, said corner-bracket strip being attached to a lower corner of a said door/window such that said horizontal portion and said vertical portion embrace said lower corner and said split straddles said roller rail of said track, and at least one plastic shim having a predetermined length, width and thickness, one side of said shim having an adhesive and being attached to a top surface of said horizontal portion on one or both sides of the split, and Wherein said at least one plastic tracking strip and said at least one Plastic corner-bracket strip come in contact with each other to make the opening and closing of said sliding door/window relatively easy.

* * * * *